United States Patent [19]

Golembeck

[11] 4,164,797

[45] Aug. 21, 1979

[54] ZIPPER CONSTRUCTION FOR MATTRESSES AND THE LIKE

[75] Inventor: Gerald A. Golembeck, Lake Elmo, Minn.

[73] Assignee: The United States Bedding Company, St. Paul, Minn.

[21] Appl. No.: 893,992

[22] Filed: Apr. 6, 1978

[51] Int. Cl.[2] ..... A47G 9/04; A47C 31/00

[52] U.S. Cl. ..... 5/470; 5/499; 24/205.11 R

[58] Field of Search ..... 5/355, 334 R, 339, 341, 5/343, 345 R; 24/205.11 R, 205.11 F, 205.11 L; 112/3 R, 406

[56] References Cited

U.S. PATENT DOCUMENTS

| | | | |
|---|---|---|---|
| 2,689,961 | 9/1954 | Libberthal | 5/334 R |
| 3,530,516 | 9/1970 | Marquette | 5/334 R |
| 3,737,930 | 6/1973 | Smith | 5/355 |

*Primary Examiner*—Thomas F. Callaghan
*Assistant Examiner*—Alex Grosz
*Attorney, Agent, or Firm*—McDougall, Hersh & Scott

[57] ABSTRACT

A mattress construction comprising a filler with a surrounding mattress cover. The cover defines an opening along at least one of its ends, and a zipper is provided for closing the opening. A fabric section of the cover is positioned in overlapping relationship with one end of the zipper. This section defines a pocket for receipt of the zipper closure when the zipper is closed to thereby reduce the likelihood that the zipper will be opened during use of the mattress.

3 Claims, 3 Drawing Figures

ZIPPER CONSTRUCTION FOR MATTRESSES AND THE LIKE

BACKGROUND OF THE INVENTION

1. Field of the Invention

This invention relates to mattress constructions. The invention is particularly concerned with mattresses comprising a filler which may be a coil spring assembly, plastic foam, or any other conventional filler. The filler is surrounded by a fabric cover, and one end of the cover defines an opening to permit insertion of the filler into the cover.

The invention is particularly concerned with mattresses of the type described wherein a zipper is utilized for closing the cover opening. The zipper will typically extend completely across one end of the cover, and a short distance along adjacent sides thereby simplifying the filler insertion.

2. Description of the Prior Art

Prior art constructions of the type described do not adequately guard against opening of the zipper once the mattress cover has been filled and the zipper closed. Thus, the zipper should be employed solely for ease of assembling the filler and cover and for limited maintenance purposes. Experience shows, however, that purchasers of mattresses often open the zipper to remove the cover, for example, for cleaning of the cover. This is done even though accompanying instructions warn against this practice. In addition, children may open the zipper which can lead to damage to the mattress.

Attempts have been made to minimize this problem by extending a fabric flap along the length of the zipper whereby the zipper closer is at least partially hidden from view. This arrangement is quite ineffective, however, since the flap does not provide any significant protection against either deliberate or inadvertent opening of the zipper.

SUMMARY OF THE INVENTION

This invention provides a mattress construction comprising a filler and associated mattress cover. In accordance with conventional design, the cover defines an opening along at least one end, and a zipper is associated with this opening. This arrangement facilitates insertion of the filler into the cover after which the zipper is closed.

In accordance with this invention, a fabric section of the cover is positioned adjacent one end of the zipper. The fabric section is designed to provide a pocket for receipt of the zipper closer. This arrangement permits utilization of the zipper in the usual fashion while, at the same time, greatly minimizing the likelihood that the zipper will be opened once the mattress has been assembled. Thus, the design of the pocket is such that the zipper closer is hidden from view and also difficult to grasp whereby there is little tendency toward opening the zipper.

The particular design of the invention involves the utilization of a fabric section which comprises a double thickness of fabric. This double thickness includes a first layer which comprises a continuation of the fabric on a side of the cover. A second layer of this fabric section comprises a return portion of the first layer.

The fabric section is stitched to the mattress cover along the fold defined by the first and second layers. This stitching is interrupted to provide an intermediate opening to the pocket for receiving the closer. The pocket itself is defined by stitching which extends inwardly of the fold between the first and second layers.

DESCRIPTION OF THE PREFERRED EMBODIMENT

Figure 1:
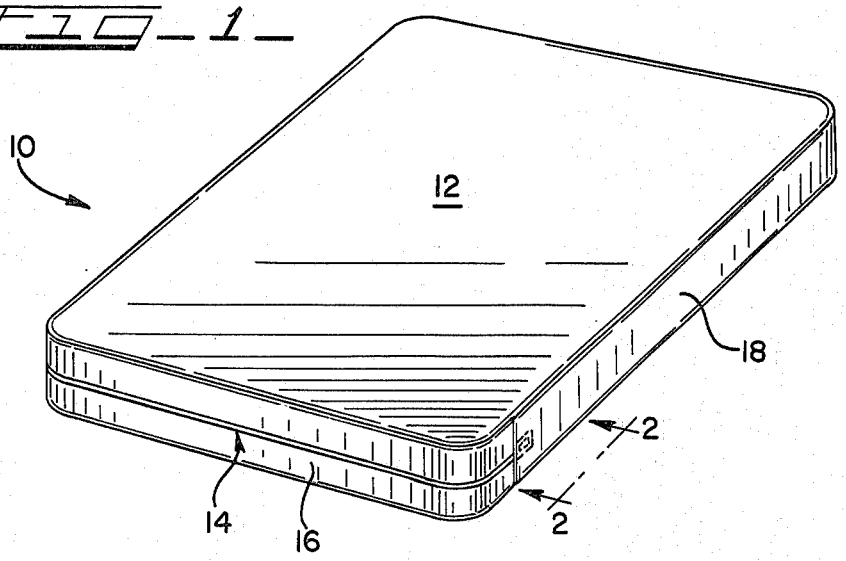
FIG. 1 is a perspective view of a mattress construction characterized by the features of this invention.

The drawings illustrate a mattress construction 10 including a cover 12 having a zipper 14 extending across one end 16. As indicated, this zipper extends around the mattress corner for a short distance along the side 18 of the cover. A corresponding extension on the other side of the mattress is also contemplated.

Figure 2:
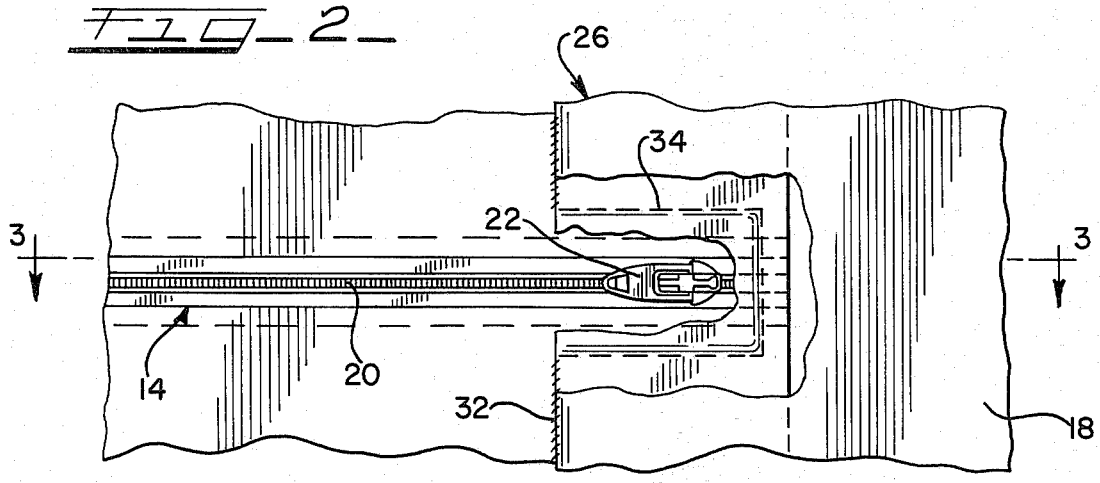
FIG. 2 is an enlarged fragmentary side elevation taken about the line 2—2 of FIG. 1; and, FIG. 3 is a cross-sectional view taken about the line 3—3 of FIG. 2.
Figure 3:
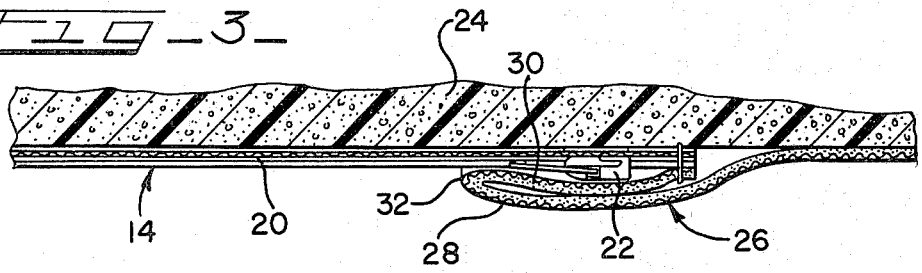

FIGS. 2 and 3 illustrate the chain portion 20 of the zipper as well as the zipper closer 22. When the zipper is closed, the closer 22 is positioned at the end of the zipper located on the side 18 of the mattress. As shown in FIG. 3, this provides a complete enclosure for the mattress filler 24. In a typical case, the zipper 14 is opened when the mattress filler is inserted in the cover. The closer 22 then moves to the position of FIGS. 2 and 3, and this closer preferably holds this position throughout the useful life of the mattress.

The means for increasing the likelihood that the zipper will not be opened includes a fabric portion 26 which extends perpendicular to the zipper 14. This fabric section overlaps the end of the zipper shown in FIGS. 2 and 3 whereby the fabric portion completely covers the closer 22 when the mattress opening has been closed.

The fabric section 26 comprises a double layer of fabric including a first layer 28 which is a continuation of the fabric forming the side 18 of the cover. A return portion 30 of the fabric forms the second layer of the fabric section. As shown, the zipper closer 22 is adapted to be positioned beneath this fabric section whereby this closer is substantially out of sight and is not readily usable for purposes of opening the zipper.

The particular construction of the invention involves stitching along the edge 32 of the fabric section, this edge comprising the fold between the layers 28 and 30. As shown, the stitching is interrupted at an intermediate position whereby the closer is adapted to be fit beneath the fabric section. It will also be noted that the underlying layer 30 is stitched to the portion of end wall 16 which extends around the corner of the mattress. This stitching, shown at 34, provides a pocket for receipt of the closer. The pocket is dimensioned so that the closer can be readily pushed into the pocket; however, it is much more difficult to back the closer out of the pocket. When this feature is combined with the fact that the closer cannot be seen once the zipper is closed, the likelihood of anyone opening the zipper is substantially reduced.

It will be appreciated that the arrangement described involves merely the utilization of fabric material already associated with the mattress cover. Thus, by merely extending the side 18 of the mattress cover in the fashion illustrated, the zipper closer pocket is readily achieved. It will be noted in particular that the stitching operations which provide the pocket and the more inaccessible closure can be readily accomplished with conventional equipment. Thus, the concept of this invention can be accomplished with substantial efficiency and without the necessity for new tooling or the like.

In particular, the stitching of the edge of fabric section 26 and of layer 30 to the underlying fabric wall is readily accomplished with standard sewing machinery by first sewing the pocket outline and then forming and sewing the folded edge 32. In this connection, it is preferred that the width of the pocket not exceed about three times the width of the closer while still being sufficiently wide to permit insertion of the closer. This insures the desired difficult removal of the closer from the pocket.

It will be understood that various changes and modifications may be made in the above described construction which provide the characteristics of this invention without departing from the spirit thereof particularly as defined in the following claims.

That which is claimed is:

1. In a mattress construction comprising a filler and a mattress cover, said cover defining an opening along at least one of its sides, and a zipper including a chain and closer for closing said opening, the improvement comprising a fabric section connected to said cover and extending perpendicular to said zipper, said section comprising a double thickness of fabric extending in overlapping relationship with a portion of the cover supporting said zipper whereby the section overlaps one end of said zipper, said double thickness including a first layer comprising a continuation of the fabric on a side of the cover and a second layer comprising a return portion of the first layer, a fold defined at the juncture of said layers, and a pocket defined by said section for receipt of said closer when said opening is closed, said fold being stitched to said portion of the fabric supporting the zipper, and wherein said stitching is interrupted at an intermediate position to provide the opening for said pocket.

2. A construction in accordance with claim 1 wherein said second layer is stitched to the portion of the fabric supporting said zipper at positions inwardly of said fold, the stitching of said second layer serving to define the sides of said pocket.

3. A construction in accordance with claim 2 wherein the width of said pocket does not exceed about three times the width of said closer.

* * * * *